US010586488B2

(12) United States Patent
Zhai et al.

(10) Patent No.: US 10,586,488 B2
(45) Date of Patent: Mar. 10, 2020

(54) PIXEL DRIVING CIRCUIT, PIXEL ARRAY, DRIVING METHOD AND ORGANIC LIGHT EMITTING DISPLAY PANEL

(71) Applicants: SHANGHAI TIANMA MICRO-ELECTRONICS CO., LTD., Shanghai (CN); TIANMA MICRO-ELECTRONICS CO., LTD., Shenzhen (CN)

(72) Inventors: Yingteng Zhai, Shanghai (CN); Gang Liu, Shanghai (CN)

(73) Assignees: SHANGHAI TIANMA MICRO-ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 170 days.

(21) Appl. No.: 15/627,369

(22) Filed: Jun. 19, 2017

(65) Prior Publication Data

US 2018/0190191 A1 Jul. 5, 2018

(30) Foreign Application Priority Data

Dec. 29, 2016 (CN) ..... 2016 1 1246033

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01); *G09G 2300/0852* (2013.01); *G09G 2310/0262* (2013.01); *G09G 2320/0233* (2013.01); *G09G 2320/045* (2013.01); *G09G 2330/02* (2013.01)

(58) Field of Classification Search
CPC ... G09G 2300/0426; G09G 2300/0819; G09G 2300/0852; G09G 2310/0262; G09G 2320/0233; G09G 2320/045; G09G 2330/02; G09G 3/3233
See application file for complete search history.

(56) References Cited

U.S. PATENT DOCUMENTS

| | | | | |
|---|---|---|---|---|
| 7,834,557 | B2 | 11/2010 | Kim | |
| 8,237,637 | B2 | 8/2012 | Chung | |
| 2008/0211397 | A1* | 9/2008 | Choi | G09G 3/3233 313/504 |
| 2009/0051628 | A1* | 2/2009 | Kwon | G09G 3/3233 345/77 |
| 2010/0013816 | A1* | 1/2010 | Kwak | G09G 3/3233 345/211 |

(Continued)

*Primary Examiner* — Kenneth Bukowski
(74) *Attorney, Agent, or Firm* — Alston & Bird LLP

(57) ABSTRACT

A pixel driving circuit, a pixel array, a driving method and an organic light emitting display panel are provided. The pixel driving circuit includes: a first transistor, a second transistor, a third transistor, a fourth transistor, a fifth transistor, a sixth transistor, a seventh transistor and a first capacitor. The sixth transistor is configured to transmit a signal with a first potential to a light emitting element in response to a second scanning line signal. The seventh transistor is configured to transmit a signal with a second potential to a gate of the second transistor in response to the second scanning line signal, and the second potential is greater than the first potential.

27 Claims, 8 Drawing Sheets

(56) References Cited

U.S. PATENT DOCUMENTS

| | | | | |
|---|---|---|---|---|
| 2013/0321375 | A1* | 12/2013 | Ka | G09G 3/3233 345/212 |
| 2017/0103701 | A1* | 4/2017 | Zhu | G09G 3/3233 |
| 2017/0249882 | A1* | 8/2017 | Lee | G09G 3/006 |
| 2017/0270853 | A1* | 9/2017 | Xiang | G09G 3/3275 |
| 2017/0301293 | A1* | 10/2017 | Zhu | G09G 3/3258 |
| 2018/0005576 | A1* | 1/2018 | Yoon | G09G 3/3233 |
| 2018/0211592 | A1* | 7/2018 | Li | G09G 3/3233 |

* cited by examiner

PIXEL DRIVING CIRCUIT, PIXEL ARRAY, DRIVING METHOD AND ORGANIC LIGHT EMITTING DISPLAY PANEL

CROSS REFERENCE TO RELATED APPLICATIONS

This application claims priority to a Chinese patent application No. CN201611246033.X, filed on Dec. 29, 2016, and entitled "PIXEL DRIVING CIRCUIT, PIXEL ARRAY, DRIVING METHOD AND ORGANIC LIGHT EMITTING DISPLAY PANEL", the disclosure of which is incorporated herein by reference in entirety.

TECHNICAL FIELD

The present disclosure relates to the display technology, and in particular relates to a pixel driving circuit, a pixel array, a driving method and an organic light emitting display panel.

BACKGROUND

In the display technology, an OLED (Organic Light Emitting Diode) display is generally recognized as a third-generation display technology after a LCD (Liquid Crystal Display) by the industry because of its advantages of slim, active light emission, high response speed, wide viewing angle, rich colors, high brightness, low power consumption, high and low temperature resistance and the like.

At present, the OLED display mainly adopts current control type light emission, and the uniformity of light emission is controlled by corresponding current. However, since the threshold voltage of driving transistors of each pixel of the OLED display easily drifts with time, the current flowing through an OLED deviates under a same data signal, causing non-uniform display brightness.

The problem of mura caused by unobscured dark states of the OLED light emitting elements and insufficient compensation for the threshold voltage of the driving transistors still exist when a pixel circuit is optimized with existing techniques an actual product. The existing techniques offer a number of solutions to improve the unobscured dark states and the insufficient compensation for the threshold voltage of the driving transistors. For example, in an application for a patent published as CN106097964A, a pixel circuit and a driving method are proposed, and the pixel circuit can compensate the threshold voltage, and reduce leakage current so as to ensure high contrast in the dark state (the unobscured dark state). However, the technical solution also has the disadvantages of having complex layout designs and involving a large number of transistors and signal leads. Therefore, it is urgent to find a technical solution which not only solves the problems of the unobscured dark states and the insufficient compensation for the threshold voltage of the driving transistors effectively, but also eliminates the complexity in layout designs.

SUMMARY

In view of this, the present disclosure provides a pixel driving circuit, a driving method and an organic light emitting display panel, so as to solve the problem of non-uniform display caused by drift of threshold voltage and the like in the existing art.

In one aspect, the present disclosure provides a pixel driving circuit, including: a first transistor, configured to transmit a data signal voltage in response to a first scanning line signal; a second transistor, configured to generate a driving current according to the data signal voltage transmitted by the first transistor; a third transistor, configured to detect a deviation of a threshold voltage of the second transistor and perform a self-compensation on the deviation; a fourth transistor, configured to transmit a first power voltage to the second transistor in response to a light emitting line signal; a fifth transistor, configured to transmit the driving current generated by the second transistor to a light emitting element in response to the light emitting line signal, where the light emitting element is configured to emit a light corresponding to the driving current; a sixth transistor, configured to transmit a signal with a first potential to the light emitting element in response to a second scanning line signal; a seventh transistor, configured to transmit a signal with a second potential to a gate of the second transistor in response to the second scanning line signal, the second potential is greater than the first potential; and a first capacitor, configured to store the data signal voltage transmitted to the second transistor.

In another aspect, the present disclosure provides a driving method of a pixel driving circuit, the pixel driving circuit includes: a first transistor, configured to transmit a data signal voltage in response to a first scanning line signal; a second transistor, configured to generate a driving current according to the data signal voltage transmitted by the first transistor; a third transistor, configured to detect a deviation of a threshold voltage of the second transistor and perform a self-compensation on the deviation; a fourth transistor, configured to transmit a first power voltage to the second transistor in response to a light emitting line signal; a fifth transistor, configured to transmit the driving current generated by the second transistor to a light emitting element in response to the light emitting line signal, the light emitting element is configured to emit a light corresponding to the driving current; a sixth transistor, configured to transmit a signal with a first potential to the light emitting element in response to a second scanning line signal; a seventh transistor, configured to transmit a signal with a second potential to a gate of the second transistor in response to the second scanning line signal, the second potential is greater than the first potential; a first capacitor, configured to store the data signal voltage transmitted to the second transistor. The driving method includes:

at an initialization phase, both the sixth transistor and the seventh transistor are turned on in response to the second scanning line signal, the signal with the first potential is transmitted to the light emitting element through the sixth transistor, and the signal with the second potential is transmitted to the gate of the second transistor through the seventh transistor;

at a data writing phase, both the first transistor and the third transistor are turned on in response to the first scanning line signal, and the data signal voltage is transmitted to the gate of the second transistor through the first transistor and the third transistor; and at a light emitting phase, both the fourth transistor and the fifth transistor are turned on in response to the light emitting line signal, and the driving current generated in response to the data signal voltage exerted on the second transistor is provided to the light emitting element through the fifth transistor, so that the light emitting element emits a light.

In another aspect, the present disclosure provides a pixel array, including: a plurality of pixel driving circuits arranged in a matrix form with N rows and M columns, both N and M are positive integers greater than or equal to 2; the pixel driving circuit in the Nth row includes: a first transistor, configured to transmit a data signal voltage in response to a Nth-row scanning line signal; a second transistor, configured to generate a driving current according to the data signal voltage transmitted by the first transistor; a third transistor, configured to detect a deviation of a threshold voltage of the second transistor and perform a self-compensation on the deviation; a fourth transistor, configured to transmit a first power voltage to the second transistor in response to a Nth-row light emitting line signal; a fifth transistor, configured to transmit the driving current generated by the second transistor to a light emitting element in response to the Nth-row light emitting line signal, the light emitting element is configured to emit a light corresponding to the driving current; a sixth transistor, configured to transmit a signal with a first potential to the light emitting element in response to the Nth-row scanning line signal; a seventh transistor, configured to transmit a signal with a second potential to the gate of the second transistor in response to a (N−1)th-row scanning line signal, the second potential is greater than the first potential in the same pixel driving circuit; and a first capacitor, configured to store the data signal voltage transmitted to the second transistor.

In yet another aspect, the present disclosure provides a driving method of a pixel array. The pixel array includes: a plurality of pixel driving circuits arranged in a matrix form with N rows and M columns, both N and M are positive integers which are greater than or equal to 2. The pixel driving circuit in the Nth row includes: a first transistor, configured to transmit a data signal voltage in response to a Nth-row scanning line signal; a second transistor, configured to generate a driving current according to the data signal voltage transmitted by the first transistor; a third transistor, configured to detect a deviation of a threshold voltage of the second transistor and perform a self-compensation on the deviation; a fourth transistor, configured to transmit a first power voltage to the second transistor in response to a Nth-row light emitting line signal; a fifth transistor, configured to transmit the driving current generated by the second transistor to a light emitting element in response to the Nth-row light emitting line signal, wherein the light emitting element is configured to emit a light corresponding to the driving current; a sixth transistor, configured to transmit a signal with a first potential to the light emitting element in response to the Nth-row scanning line signal; a seventh transistor, configured to transmit a signal with a second potential to a gate of the second transistor in response to a (N−1)th-row scanning line signal, wherein the second potential is greater than the first potential in the same pixel driving circuit; and a first capacitor, configured to store the data signal voltage transmitted to the second transistor. The driving method of the pixel array includes:

at an initialization phase, the seventh transistor is turned on in response to the (N−1)th-row scanning line signal, and the signal with the second potential is transmitted to the gate of the second transistor through the seventh transistor and a sixth transistor in the pixel driving circuit in the (N−1)th row in the same column;

at a data writing phase, the first transistor, the third transistor and the sixth transistor are turned on in response to the Nth-row scanning line signal, the data signal voltage is transmitted to the gate of the second transistor through the first transistor and the third transistor, and the signal with the first potential is transmitted to the light emitting element through the sixth transistor; and at a light emitting phase, both the fourth transistor and the fifth transistor are turned on in response to the Nth-row light emitting line signal, and the driving current generated in response to the data signal voltage exerted on the second transistor is provided to the light emitting element by the fifth transistor, so that the light emitting element emits a light.

In one aspect, the present disclosure provides an organic light emitting display panel, including the above pixel array.

Through a large number of experiments and effort, the technical solution is found which can effectively solve the technical problems of unobscured dark states and insufficient threshold compensation; and in addition, the circuit has simpler structure, thereby saving layout foot print.

BRIEF DESCRIPTION OF DRAWINGS

The embodiments of the present disclosure are described more clearly, with drawings showing the details introduced below. It is apparent that the drawings in the following descriptions only show some embodiments of the present disclosure, and those ordinary skilled in the art can also obtain other drawings according to the disclosed materials.

DETAILED DESCRIPTION

Figure 1:
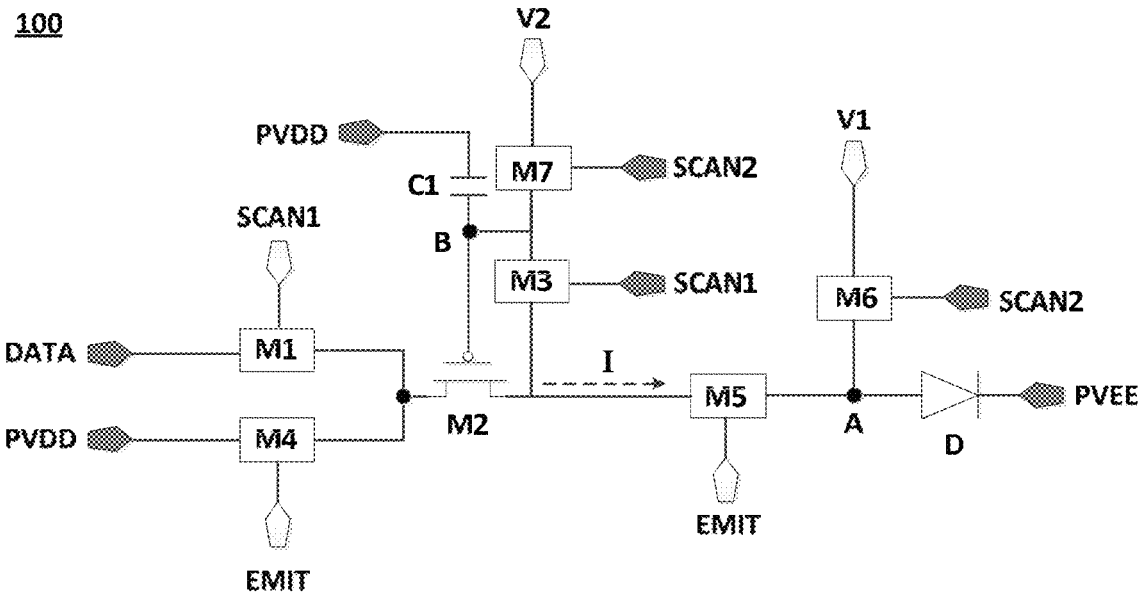
FIG. 1 is a schematic diagram illustrating a pixel driving circuit provided by an embodiment of the present disclosure.

The above purposes, features and advantages of various embodiments are made more apparent and easier to understand with the detailed description in combination with drawings below.

Through experiments and research in the field of pixel circuits, the inventor discovers that in a phase of threshold compensation of a pixel driving circuit for a driving transistor (for example, a second transistor M2 in FIG. 4), a potential (for example, a second potential V2 in FIG. 4) for compensating the driving transistor's gate to be lower than the data signal voltage (for example, DATA in FIG. 4), and the difference between the data signal voltage and the driving transistor's threshold voltage is required to be greater than the threshold voltage of the driving transistor. To meet the above conditions, the closer the compensating voltage is to the data signal voltage, the better a compensation effect is. The problem of mura will be greater from insufficient compensation voltage at the driving transistor's gate. Therefore, the inventor's experiments under a usual technological conditions and confirmed that the voltage for compensating the gate of the driving transistor has to be in a range not lower than the data signal voltage yet not higher than the requirement of the pixel driving circuit. It has been confirmed by the inventor that the compensating voltage at the driving transistor's gate is more appropriately set as −2V to 1V (the transistors in the pixel driving circuit are all P-type transistors). In addition, generally, an anode of a light emitting diode (LED) in the circuit needs to be reset before the pixel driving circuit emits light, so that the potential difference between the anode and a cathode of the LED is far less than the LED turn-on voltage (i.e., the voltage when the LED emits light) of in a non-light emitting phase. Through the experiments, the inventor discovered that parasitic capacitance exists between the cathode and the anode of the LED, so that a black screen in a light emitting phase cannot emit light even if the driving transistor (for example, the second transistor M2 in FIG. 4) has electric leakage when the black screen is displayed in the light emitting phase. Generally, the lower the reset voltage of the anode is, the better the effect is. However, through actual experiments and research, the inventor discovered that in the resetting of the anode of the LED in the circuit, all these factors need to be considered: power consumption of a display's charging signal, the voltage endurance capability of an IC (Integrated Circuit), additional current generated by electric leakage of a resetting transistor (for example, a sixth transistor M6 in FIG. 4) and specific design factors of different pixels (for example, the size of the parasitic capacitance of the LED, the width of the driving transistor related to leakage current, etc.) . Therefore, the reset voltage of the anode of the LED needs to be set within a reasonable range, so that the reset voltage is in the light emitting phase of the black screen. The voltage of the anode of the LED cannot be charged to the turn-on voltage by the leakage current of the driving transistor or cannot improve the power consumption of the display. Through experiments on different types of organic light emitting display panels, the inventor finally determined that the reset voltage of the anode of the LED is best set at approximately −3.5 to −4.5V (the transistors in the pixel driving circuit are all P-type transistors).

Therefore, through the above two aspects of researches, the inventor discovered and obtained a design: an initialized potential (the second potential) of the gate of the driving transistor is greater than an input potential (a first potential) of the anode of the OLED, so that two important nodes in the same pixel driving circuit can be initialized optimally and respectively, and the above many technical problems can be solved.

Pixel driving circuits for specifically realizing the above technical effects are shown in the solutions of following embodiments.

FIG. 1 shows a pixel driving circuit 100 provided by an embodiment of the present disclosure. The pixel driving circuit 100 specifically includes: a first transistor M1, configured to transmit a data signal voltage DATA in response to a first scanning line signal SCAN1; a second transistor M2, configured to generate a driving current I according to the data signal voltage DATA transmitted by the first transistor M1; a third transistor M3, configured to carry out a detection and self-compensation on a threshold voltage deviation of the second transistor M2; a fourth transistor M4, configured to transmit a first power voltage VDD to the second transistor M2 in response to a light emitting line signal EMIT; a fifth transistor M5, configured to transmit the driving current I generated by the second transistor M2 to a light emitting element D in response to the light emitting line signal EMIT, where the light emitting element D is configured to emit a light corresponding to the driving current I; a sixth transistor M6, configured to transmit a signal V1 with a first potential to the light emitting element D in response to a second scanning line signal SCAN2; a seventh transistor M7, configured to transmit a signal V2 with a second potential to a gate of the second transistor M2 in response to the second scanning line signal SCAN2, where the second potential is greater than the first potential; and a first capacitor C1, configured to store the data signal voltage DATA transmitted to the second transistor M2.

For the embodiment shown in FIG. 1, each of the signal V1 and the signal V2 represents an electrical signal which may have any potential when being output from a signal source. The potential is not limited in the present embodiment as long as the followings are ensured: the signal V1 has a first potential v1 when being transmitted to the light emitting element D (that is, a node A) through the sixth transistor M6; and the signal V2 has a second potential v2 when being transmitted to the gate of the second transistor M2 (that is, a node B) through the seventh transistor M7, and the second potential v2 is greater than the first potential v1. The node A is a node, at which a signal output end of the sixth transistor M6 is electrically connected with an input end of the light emitting element D (the input end of the light emitting element D is an anode when the light emitting element D is an OLED element), and the node B is a node, at which a signal output end of the seventh transistor M7 is electrically connected with the gate of the second transistor M2.

For the embodiment shown in FIG. 1, the second transistor M2 is a P-type transistor, which is not a limit to the type of the second transistor M2; and specifically, the first transistor M1 to the seventh transistor M7 may be all P-type transistors or N-type transistors, or a part of transistors are the P-type transistors, and the other part of transistors are the N-type transistors. Under the situation that the first transistor M1 to the seventh transistor M7 are all P-type transistors, signal input ends of the first transistor M1 to the seventh transistor M7 are generally sources, and signal output ends of the first transistor M1 to the seventh transistor M7 are generally drains; and in this case, both the signal V1 and the signal V2 are low-potential signals. Under the situation that the first transistor M1 to the seventh transistor M7 are all N-type transistors, the signal input ends of the first transistor M1 to the seventh transistor M7 are generally drains, and the signal output ends of the first transistor M1 to the seventh transistor M7 are generally sources; and in this case, both the signal V1 and the signal V2 are high-potential signals.

Figure 2:
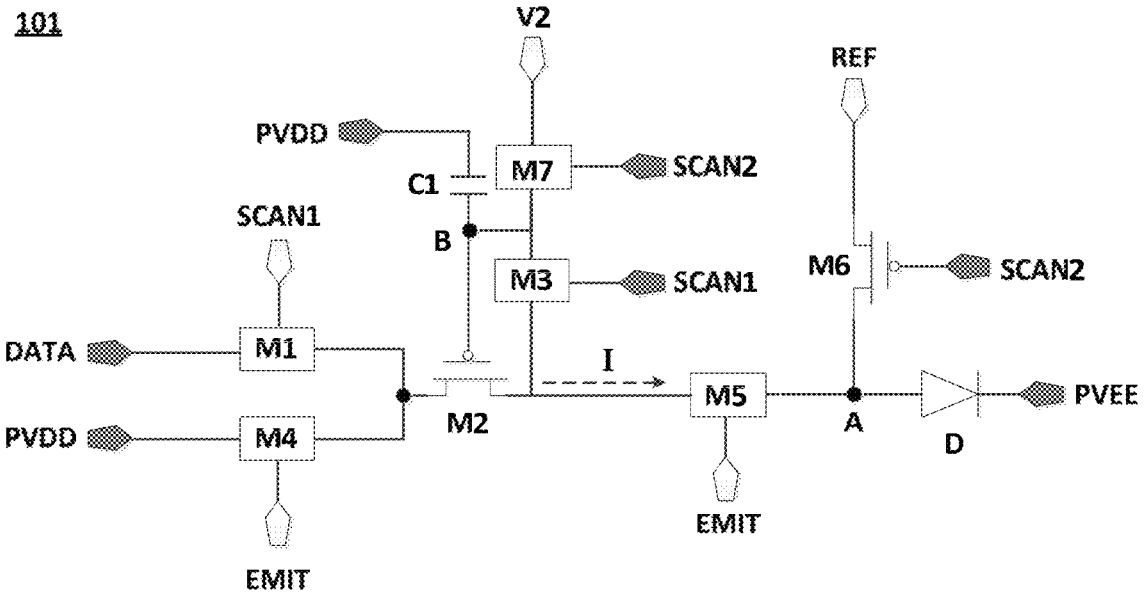
FIG. 2 is a schematic diagram illustrating another pixel driving circuit provided by an embodiment of the present disclosure.

FIG. 2 shows another pixel driving circuit 101 provided by an embodiment of the present disclosure. The pixel driving circuit 101 has many similarities with the pixel driving circuit 100 in the embodiment of the present disclosure shown in FIG. 1, and the similarities are not repeated again and can refer to the above contents. Herein, merely the differences between the above embodiments are described.

In the pixel driving circuit 101 provided by the embodiment illustrated in FIG. 2, the gate of the sixth transistor M6 is electrically connected with a second scanning line for transmitting the second scanning line signal SCAN2, a first electrode (an input end) of the sixth transistor M6 is electrically connected with a reference signal line for transmitting a reference signal REF, a second electrode (an output end) of the sixth transistor M6 is electrically connected with the light emitting element D, and the sixth transistor M6 is configured to transmit the reference signal REF with a first potential to the light emitting element D in response to the second scanning line signal SCAN2. The seventh transistor M7 is configured to transmit a signal V2 with a second potential to the gate of the second transistor M2 in response to the second scanning line signal SCAN2, and the second potential is greater than the first potential.

For the embodiment shown in FIG. 2, the reference signal REF only represents an electrical signal which may have any potential, and the potential is not limited in the present embodiment, and only needs to ensure that: the reference signal REF has a first potential v1 when being transmitted to the light emitting element D (that is, the node A) through the sixth transistor M6; and a signal V2 has a second potential v2 when being transmitted to the gate of the second transistor M2 (that is, the node B) through the seventh transistor M7, and the second potential v2 is greater than the first potential v1.

It should be noted that, for the pixel driving circuit 101 of the embodiment shown in FIG. 2, the second electrode (the output end) of the sixth transistor M6 may be electrically connected with the light emitting element D in a direct connection manner or an indirect connection manner as long as the following is ensured: the reference signal REF has the first potential v1 when being transmitted to the light emitting element D (that is, the node A) trough the sixth transistor M6, and the second potential v2 is greater than the first potential v1. In the direct connection manner, the second electrode (the output end) of the sixth transistor M6 is directly connected with the input end of the light emitting element D (the input end of the light emitting element D is the anode when the light emitting element D is an OLED element). In the indirect connection manner, for example, other elements or elements and the like besides a connecting lead are also included between two connection points.

Figure 3:
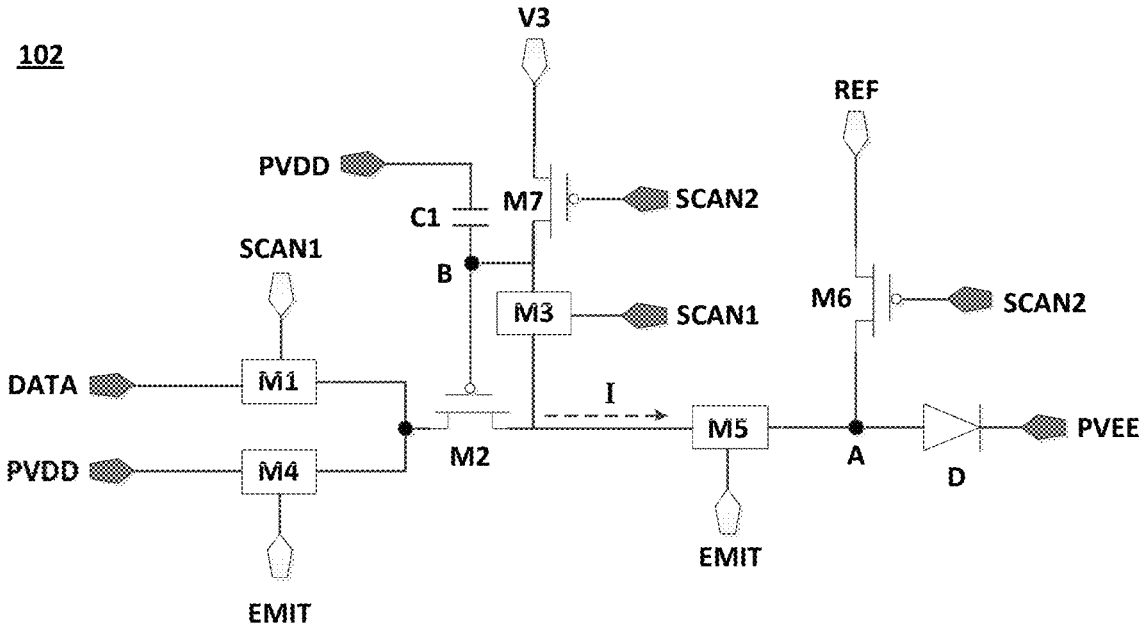
FIG. 3 is a schematic diagram illustrating another pixel driving circuit provided by an embodiment of the present disclosure.

FIG. 3 shows another pixel driving circuit 102 provided by an embodiment of the present disclosure. The pixel driving circuit 102 has many similarities with the pixel driving circuits in embodiments of the present disclosure shown in FIG. 1 and FIG. 2, the similarities are not repeated again and can refer to the above contents, and the key points described herein are only the differences between the pixel driving circuit 102 and the pixel driving circuit 101 shown in FIG. 2 (wherein part of contents may be understood as differences between FIG. 3 and FIG. 1.):

The gate of the seventh transistor M7 is electrically connected with a second scanning line for transmitting the second scanning line signal SCAN2, an input end of the seventh transistor M7 is electrically connected with an additional reference signal line for providing an additional reference signal V3; and a second electrode of the seventh transistor M7 is electrically connected with the gate of the second transistor M2. For the embodiment shown in FIG. 3, the additional reference signal V3 only represents a signal which may have any potential, and the potential is not limited in the present disclosure as long as the following is ensured: the reference signal REF has a potential value of the first potential v1 when being transmitted to the light emitting element D (that is, the node A) through the sixth transistor M6; meanwhile, the additional reference signal V3 has the second potential v2 when being transmitted to the gate of the second transistor M2 (that is, the node B) through the seventh transistor M7, and the second potential v2 is greater than the first potential v1.

It should be noted that, for the pixel driving circuit 102 of the embodiment shown in FIG. 3, the first electrode (the input end) of the seventh transistor M7 may be electrically connected with a signal source for outputting the additional reference signal V3 directly, or be connected with the signal source indirectly (for example, other elements or devices and the like besides a connecting lead also being included between two connection points), and similarly, the first electrode (the input end) of the sixth transistor M6 may be electrically connected with a signal source for outputting the reference signal REF directly, or be connected with the signal source indirectly (for example, other elements or devices and the like besides a connecting lead also being included between two connection points, as long as the followings are ensured: the additional reference signal V3 has the second potential v2 when being transmitted to the gate of the second transistor M2 (that is, the node B) through the seventh transistor M7; and the reference signal REF has the first potential v1 when being transmitted to the node A through the sixth transistor M6, and the second potential v2 is greater than the first potential v1. Specifically, the structure of the sixth transistor M6 may be the same as that of the seventh transistor M7 (the width-to-length ratios of channels and the quantities of discrete gates are same); the additional reference signal line and the reference signal line are two independent signal lines; the reference signal REF is transmitted to the node A through the reference signal line, and the additional reference signal V3 is transmitted to the node B through the reference signal line respectively; and the value of an initialized potential of the additional reference signal V3 is set to be greater than that of the reference signal REF, therefore, the second potential v2 is greater than the first potential v1 by means of such design.

For the present disclosure, through experiments, the inventor further researches the influence of the width-to-length ratio of the channels of the sixth transistor M6 and the seventh transistor M7 and the quantities of the gates (the discrete gates) of the sixth transistor M6 and the seventh transistor M7 on the second potential v2 and the first potential v1, as shown in Table 1 below. In Table 1, the inventor focuses on simulating ten groups of data, each group of data includes: a quantity P of the discrete gates of the sixth transistor M6, a quantity Q of the discrete gates of the seventh transistor M7, a width-to-length ratio W(um)/L (um) of the channel of the seventh transistor M7, a potential VREF(V) of the reference signal REF, charging time (us) of the signals, a potential (V) of the node B and a proportion (%) of a free space. It should be noted that, in an experimentation process, the inventor determines the quantity P of the discrete gates of the sixth transistor M6 as 1, the potential VREF(V) of the reference signal REF as −4V, and the charging time of the signals as 3 μs.

TABLE 1

Influence of different width-to-length ratios W/L and different quantities Q of the discrete gates of the seventh transistor M7 on the potential of the node B, and the proportion of the free space.

| | P | Q | W(um)/L(um) | VREF(V) | Charging Time (us) | Potential (V) of Node B | Proportion (%) of Free Space |
|---|---|---|---|---|---|---|---|
| (1) | 1 | 1 | 3/4 | −4 | 3 | −3.7 | 33 |
| (2) | 1 | 4 | 3/4 | −4 | 3 | −3.4 | 133 |
| (3) | 1 | 1 | 3/24 | −4 | 3 | −3.4 | 99 |
| (4) | 1 | 2 | 3/4 | −4 | 3 | −3.6 | 66 |
| (5) | 1 | 5 | 3/4 | −4 | 3 | −3.4 | 142 |
| (6) | 1 | 1 | 3/14 | −4 | 3 | −3.6 | 66 |
| (7) | 1 | 1 | 3/40 | −4 | 3 | −3.3 | 133 |
| (8) | 1 | 2 | 3/40 | −4 | 3 | −3.9 | 139 |
| (9) | 1 | 3 | 3/4 | −4 | 3 | −3.5 | 99 |
| (10) | 1 | 1 | 3/34 | −4 | 3 | −3.2 | 133 |

When treating the data in Table 1, the inventor discovered that different quantities Q of the discrete gates of the seventh transistor M7 and different width-to-length ratios of the channels of the seventh transistor M7 have greater influence on the potential (the second potential v2) of the node B; meanwhile, by taking a design that each pixel driving circuit includes seven transistors and one capacitor as an example, different quantities Q of the discrete gates of the seventh transistor M7 and different width-to-length ratios of the channels of the seventh transistor M7 also affect the proportion of the free space of a whole display panel. Additionally, the inventor observes that the potential of the node B is equal to −3.4V, and the proportion of the free space is close to 100% when the quantity P of the discrete gates of the sixth transistor M6 is equal to 1, the quantity Q of the discrete gates of the seventh transistor M7 is equal to 1, and the width-to-length ratio W/L of the channels of the seventh transistor M7 is equal to 3/24. Compared with other data, such group of data can maximally utilize the proportion of the free space on the basis that the potential of the node B is ensured to be relatively higher, which belongs to an optimal design desired by the inventor. Additionally, the inventor also observes that the potential of the node B is equal to −3.5V, and the proportion of the free space is close to 100% when the quantity P of the discrete gates of the sixth transistor M6 is equal to 1, the quantity Q of the discrete gates of the seventh transistor M7 is equal to 3, and the width-to-length ratio W/L of the channels of the seventh transistor M7 is equal to 3/4. Compared with other data, such group of data can also maximally utilize the proportion of the free space on the basis that the potential of the node B is ensured to be relatively higher, which belongs to another optimal design desired by the inventor.

The inventor also observes that there are designing solutions the proportion of the free space of which is over 100% in Table 1. That is to say, for the display panel with a fixed size, the quantity of pixels (the quantity of the transistors) cannot be increased, and the inventor only can increase the size of the transistors, causing the reduction of a PPI (Pixel Per Inch), which is not desired by the inventor. The inventor is surprised to discover, when sorting the data, that through data groups (1), (6), (3) and (10), the potential (the second potential v2) of the node B increases along with the decrease of the width-to-length ratio of the channels of the seventh transistor M7, and the greater the potential of the node B is, the easier the solution for the problem of insufficient compensation in above embodiments becomes; however, the proportion of the free space is over 100% when the width-to-length ratio of the channels of the seventh transistor M7 is greater than 3/24, causing the reduction of the PPI. Therefore, preferably, the width-to-length ratio of the channels of the seventh transistor M7 is 3/24, namely, the ratio of the width-to-length ratio of the channels of the sixth transistor M6 and the width-to-length ratio of the channels of the seventh transistor M7 is close to 6/1, which is an optimal design, and the optimal design has the results of better improving the values of the first potential v1 and the second potential v2 and improving the proportion of the free space of the whole display panel. Meanwhile, through data groups (1), (4), (9) and (2), the inventor also confirms that the potential (the second potential v2) of the node B increases along with the increase of the quantity Q of the discrete gates of the seventh transistor M7, and the greater the potential of the node B is, the easier the solution for the problem of insufficient compensation in above embodiments becomes; however, the proportion of the free space is over 100% when the quantity Q of the discrete gates of the seventh transistor M7 is greater than 3, causing the reduction of the PPI. Therefore, preferably, the quantity Q of the discrete gates of the seventh transistor M7 is 3, which is an optimal design, and the optimal design has the results of better improving the values of the first potential v1 and the second potential v2 and improving the proportion of the free space of the whole display panel.

Through adoption of such design, the threshold compensation is ensured to be completed for the pixel driving circuit, and at the same time, the initialization of the nodes can be completed for the whole pixel driving circuit. Therefore, the problem of unobscured dark state and insufficient compensation is improved without providing too much transistors and signal lines, so as to achieve the purpose of save layout area.

Figure 4:
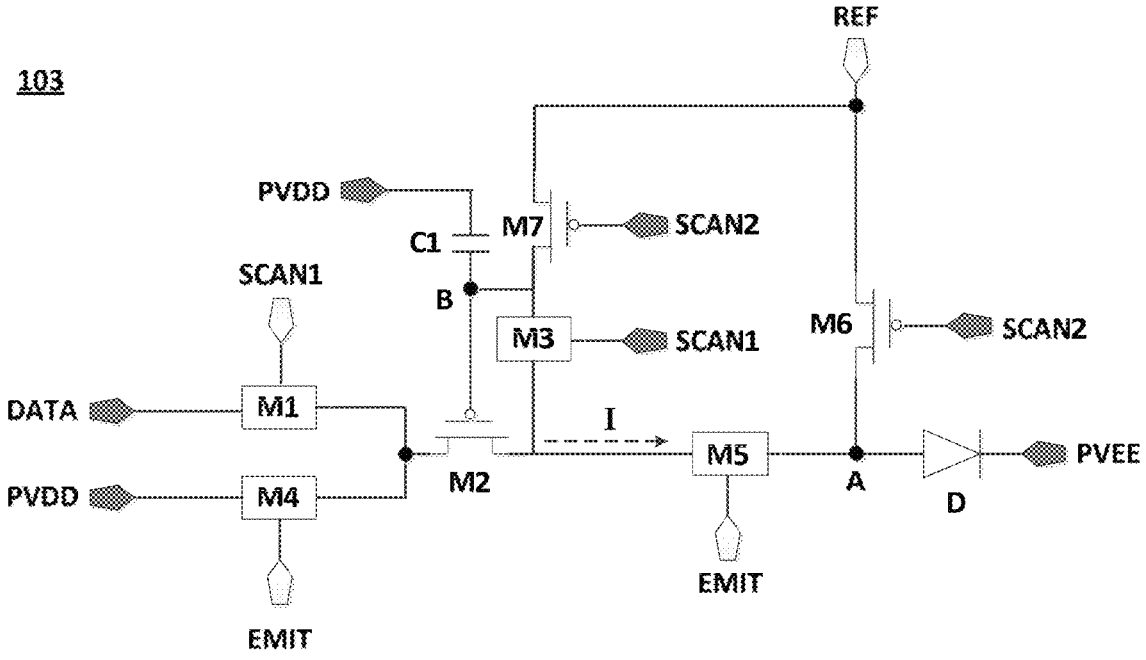
FIG. 4 is a schematic diagram illustrating another pixel driving circuit provided by an embodiment of the present disclosure.

FIG. 4 shows another pixel driving circuit 103 provided by an embodiment of the present disclosure. The pixel driving circuit 103 has many similarities with the pixel driving circuit in the embodiment of the present disclosure shown in FIG. 3, the similarities are not repeated again and can refer to the above contents, and the key points described herein are only the differences between the pixel driving circuit 103 and the pixel driving circuit 102 shown in FIG. 3.

A gate of the seventh transistor M7 is electrically connected with the second scanning line for transmitting the second scanning line signal SCAN2, the first electrode (the input end) of the seventh transistor M7 is electrically connected with the first electrode of the sixth transistor M6, and the second electrode of the seventh transistor M7 is electrically connected with the gate of the second transistor M2. As for the embodiment shown in FIG. 4, the reference signal REF only represents a signal which may have any potential. The potential is not limited in the present disclosure as long as the followings are ensured: the reference signal REF has the first potential v1 when being transmitted to the light emitting element D (that is, the node A) through the sixth transistor M6; meanwhile, the reference signal REF has the second potential v2 when being transmitted to the gate of the second transistor M2 (that is, the node B) through the seventh transistor M7, and the second potential v2 is greater than the first potential v1. Specifically, the present embodiment differs from the embodiment shown in FIG. 3 in that: one reference signal line is adopted to provide signals to the sixth transistor M6 and the seventh transistor M7 simultaneously, thereby saving layout area. Moreover, in order to ensure that the second potential v2 is greater than the first potential v1, the sixth transistor M6 and the seventh transistor M7 can be configured as having different structures, and a specific way is as follows.

In the embodiment shown in FIG. 4, in order that the second potential v2 is greater than the first potential v1, one optional solution is setting a width-to-length ratio of a channel of the sixth transistor M6 to be greater than that of the seventh transistor M7. Through experiments, the inventor discovers that the greater the width-to-length ratio of the channel of the transistor is, the relatively stronger the driving capability of the transistor is. Therefore, when the reference signal REF (taking a pure P-type transistor circuit and a reference signal at low-potential as examples.) with the same initial potential passes through the sixth transistor M6, the stronger driving capability enables the reference signal to be more easily transmitted to the node A in a unit time, so that the first potential v1 is closer to the initial low potential of the reference signal REF. On the other hand, when the reference signal REF with the initial potential passes through the seventh transistor M7 with weaker driving capability, the weaker driving capability enables the reference signal to be more difficultly transmitted to the node B in a unit time, so that the second potential v2 is not close to the initial low potential of the reference signal REF, and the second potential v2 is greater than the first potential v1. For example, after a light emitting phase of a previous frame is ended, the potential of the node A is greater than the initial potential of the reference signal REF. The initial potential of the reference signal REF is about −3.0V, the first potential v1 at the node A is about −2.0V after the reference signal REF passes through the sixth transistor M6 with the stronger driving capability, the second potential v2 at the node B is about −1.0V after the reference signal REF passes through the seventh transistor M7 with the weaker driving capability, and therefore, the second potential v2 is greater than the first potential v1.

Figure 5:
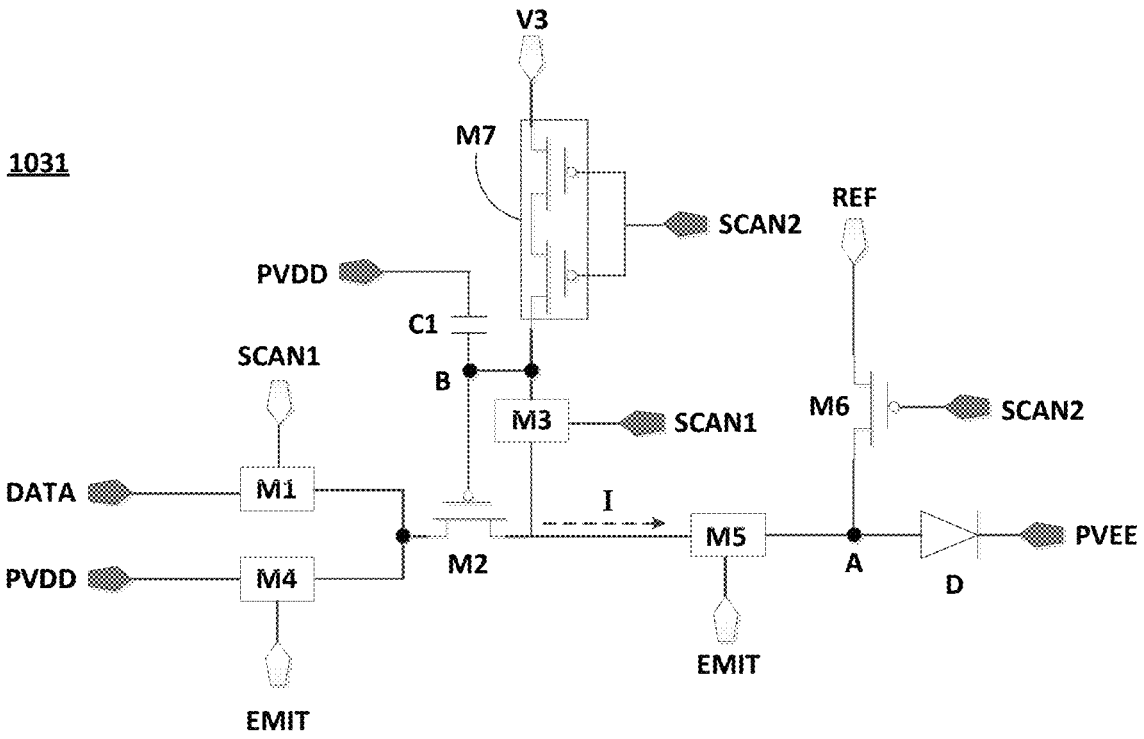
FIG. 5 is a schematic diagram illustrating another pixel driving circuit provided by an embodiment of the present disclosure.

In the embodiment shown in FIG. 4, in order that the second potential v2 is greater than the first potential v1, another optional solution is setting the total number of gates (discrete gates) of the sixth transistor M6 as P, and setting the total number of the gates (discrete gates) of the seventh transistor M7 as Q, both P and Q are positive integers which are greater than or equal to 1, and Q is greater than P. For example, similar to a pixel driving circuit 1031 of an embodiment of the present disclosure shown in FIG. 5, P is equal to 1, and Q is equal to 2. Through experiments, the inventor discovers that the driving capability of the transistor is reduced along with the increase of the total number of the gates when there exists a plurality of gates in the transistor, namely, with respect to the reference signal REF with the same initial potential, the first potential v1 is obtained at the node A after the reference signal REF passes through the sixth transistor M6 with relatively less number of gates, while the second potential v2 is obtained at the node B after the reference signal REF passes through the seventh transistor M7 with relatively larger number of gates, and the first potential v1 is less than the second potential v2. For example, after the light emitting phase of the previous frame is ended, the potential of the node A is greater than the initial potential of the reference signal REF. Specifically, the initial potential of the reference signal REF is about −3.0V, the first potential v1 at the node A is about −2.0V after the reference signal REF passes through the sixth transistor M6 with relatively less number of the gates, the second potential v2 at the node B is about −1.0V after the reference signal REF passes through the seventh transistor M7 with relatively larger number of the gates, and therefore, the second potential v2 is greater than the first potential v1.

Figure 6:
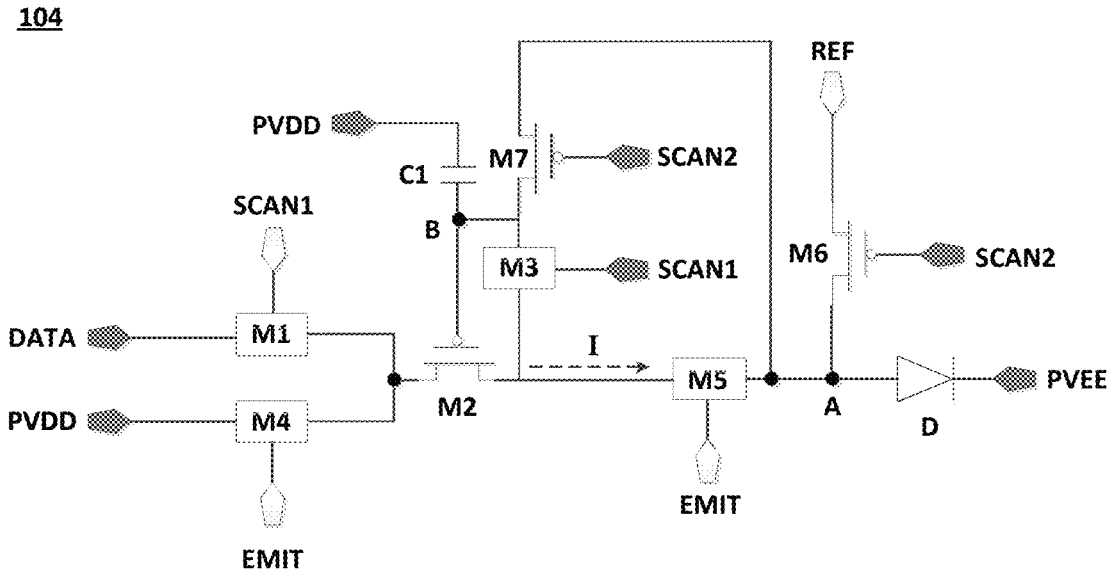
FIG. 6 is a schematic diagram illustrating another pixel driving circuit provided by an embodiment of the present disclosure.

FIG. 6 shows another pixel driving circuit 104 provided by an embodiment of the present disclosure. The pixel driving circuit 104 has many similarities with the pixel driving circuits in embodiments of the present disclosure shown in FIGS. 1-4, the similarities are not repeated again and can refer to the above contents, and the key points described herein are only the differences between the pixel driving circuit 104 and the pixel driving circuit 102 and the distinguishing points between the pixel driving circuit 104 and the pixel driving circuit 103.

In FIG. 6, the gate of the seventh transistor M7 is electrically connected with the second scanning line for transmitting the second scanning line signal SCAN2, the input end of the seventh transistor M7 is electrically connected with the second electrode (the output end) of the sixth transistor M6 at the node A, and the second electrode of the seventh transistor M7 is electrically connected with the gate of the second transistor M2. For the embodiment shown in FIG. 6, the reference signal REF only represents a signal which may have any potential. The potential is not limited in the present disclosure as long as the followings are ensured: the reference signal REF has the first potential v1 when being transmitted to the light emitting element D (that is, the node A) through the sixth transistor M6; then, the reference signal REF is changed from the first potential v1 to the second potential v2 when the reference signal REF with the first potential v1 is transmitted to the gate of the second transistor M2 (that is, the node B) through the seventh transistor M7, and the second potential v2 is greater than the first potential v1.

For the pixel driving circuit 104 in the embodiment shown in FIG. 6, the reason why the second potential v2 is greater than the first potential v1 is explained herein: the reference signal REF (the initial potential of which is not limited) is transmitted to the node A through the sixth transistor M6, that is, the reference signal REF passes through one transistor before being transmitted to the node A. Therefore, compared with the potential of the reference signal REF before the reference signal REF passes through the transistor, the potential of the reference signal REF is changed to the first potential v1 after the reference signal REF arrives at the node A due to the existence of the transistor (which may be regarded as an element or a device with a certain impedance) and the driving capability of the transistor and the like. Further, the reference signal REF is transmitted to the node B through the seventh transistor M7 after arriving at the node A, and at the moment, the potential is further changed from the first potential v1 to the second potential v2. For example, by taking the situation that both the sixth transistor M6 and the seventh transistor M7 in FIG. 6 are P-type transistors FIG. as an example, after a light emitting phase of a previous frame is ended, the potential of the node A is greater than the initial potential of the reference signal REF. Initially, the reference signal REF is a signal with any low potential; the reference signal REF needs to pass through one transistor, so that the potential of the reference signal REF is changed to the first potential v1 when the signal passes through the sixth transistor M6 and arrives at the node A; the reference signal REF passes through two transistors in total when arriving at the node B. Therefore, the potentials at the two nodes are completely different though the reference signal is the same, namely, the second potential v2 is greater than the first potential v1.

Through adoption of such design, the threshold compensation for the pixel driving circuit is ensured, and at the same time, the initialization of different potentials at different nodes for an anode of the light emitting element and the gates of driving transistors in the whole pixel driving circuit can be realized. Therefore, the problems of dim bright state and unobscured dark state are solved. In addition, compared with above embodiments, only one reference signal line needs to be designed in the improvement manner, thereby further achieving the purpose of saving layout area. Namely, compared with the embodiment shown in FIG. 3, the embodiment shown in FIG. 6 further has the following advantages: in the embodiment shown in FIG. 3, two signal lines (one of which is the reference signal line, and the other is the additional reference signal line) are configured to transmit two signals with different initial potentials, so that the potential at the node A is lower than that at the node B. On the contrary, only one reference signal line is designed in the embodiment shown in FIG. 6. Specifically, the signal passes through the sixth transistor first and then passes through the seventh transistor, so that the potential at the node A is lower than that at the node B. Therefore, the above problems are solved and the layout area is further saved at the same time.

It should be noted that, for the embodiment shown in FIG. 6, the width-to-length ratios of the channels of the first transistor M1 to the seventh transistor M7 and the total number of the discrete gates of each transistor are not limited and may be randomly adjusted, as long as the followings are ensured: the reference signal REF has the first potential v1 when being transmitted to the light emitting element D (that is, the node A) through the sixth transistor M6; and the potential of the reference signal REF is changed from the first potential v1 to the second potential v2 when the reference signal REF with the first potential v1 is transmitted to the gate of the second transistor M2 (that is, the node B) through the seventh transistor M7, and the second potential v2 is greater than the first potential v1.

It may be understood that, for the embodiment shown in FIG. 6, the width-to-length ratios of the channels of the first transistor M1 to the seventh transistor M7 and the total number of the discrete gates of each transistor may also be additionally set, in particular to the setting for the sixth transistor M6 and the seventh transistor M7. Specifically, referring to embodiments corresponding to FIG. 4 and FIG. 5, on the basis that the structure of the circuit is designed as the pixel driving circuit 104 in FIG. 6, the width-to-length ratio of the channel of the sixth transistor M6 is set to be greater than that of the seventh transistor M7, or the total number of the gates (the discrete gates) of the sixth transistor M6 is set as P, the total number of the gates (the discrete gates) of the seventh transistor M7 is set as Q, both P and Q are positive integers which are greater than or equal to 1, and Q is greater than P. Therefore, the second potential v2 is enabled to be greater than the first potential v1. The specific design manner may refer to the above contents, which is not repeated again.

Figure 7:
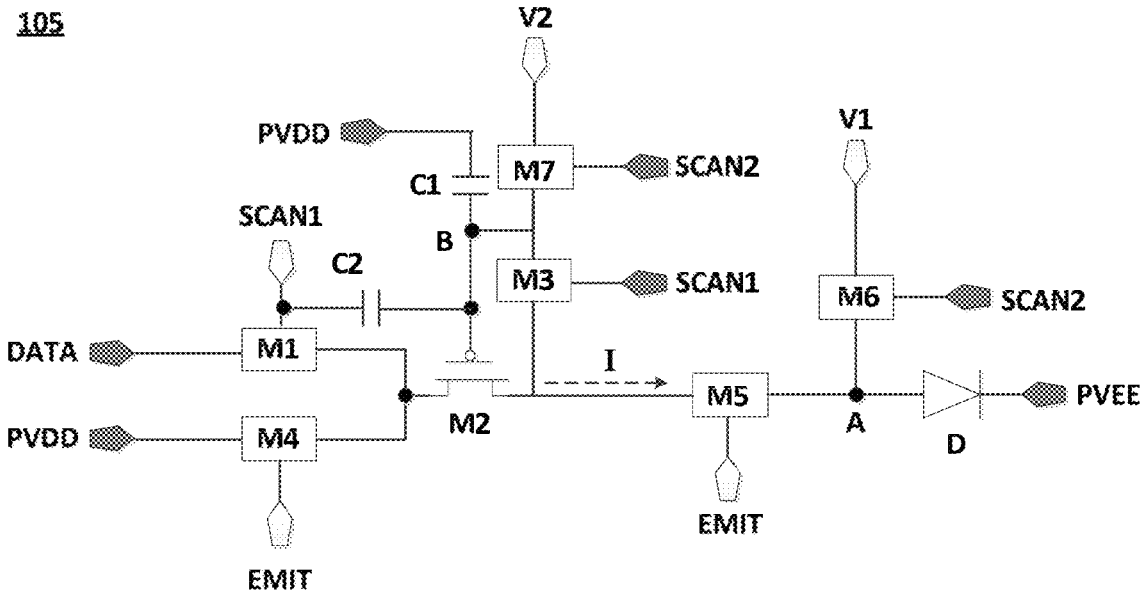
FIG. 7 is a schematic diagram illustrating another pixel driving circuit provided by an embodiment of the present disclosure.

FIG. 7 shows another pixel driving circuit 105 provided by an embodiment of the present disclosure. The pixel driving circuit 105 has many similarities with the pixel driving circuits in above embodiments of the present disclosure, the similarities are not repeated again and can refer to the above contents, and the key points described herein are only the differences between the pixel driving circuit 105 and the above pixel driving circuits.

Specifically, the pixel driving circuit 105 further includes a second capacitor C2. A first electrode of the second capacitor C2 is electrically connected with the gate (a signal control terminal) of the first transistor M1, and a second electrode of the second capacitor C2 is electrically connected with the gate of the second transistor M2.

It may be understood that, the design manner of the second capacitor in the embodiment shown in FIG. 7 is also suitable for the structure of the circuit in any of embodiments shown in FIGS. 1-6, which is not repeated again.

Figure 8:
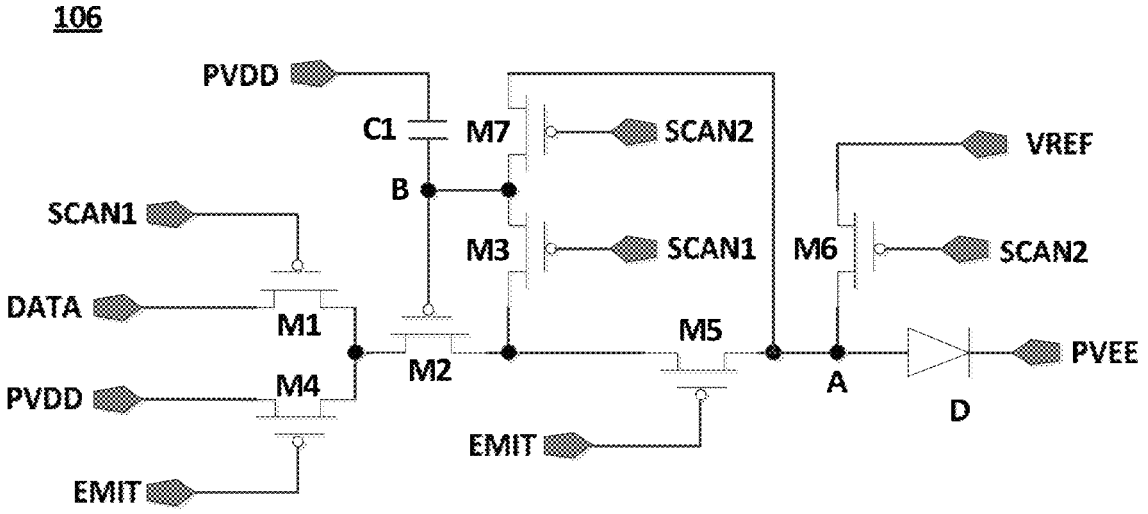
FIG. 8 is a schematic diagram illustrating another pixel driving circuit provided by an embodiment of the present disclosure.

FIG. 8 shows another pixel driving circuit 106 provided by an embodiment of the present disclosure. The pixel driving circuit 106 includes: the first transistor M1 to the seventh transistor M7; the gate of the first transistor M1 is electrically connected with the first scanning line for transmitting the first scanning line signal SCAN1; the first electrode of the first transistor M1 is electrically connected with a data signal line for transmitting a data signal voltage DATA; and the second electrode of the first transistor M1 is electrically connected with the first electrode of the second transistor M2. The gate of the second transistor M2 is electrically connected with the second electrode of the seventh transistor M7, the first electrode of the second transistor M2 is electrically connected with the second electrode of the first transistor M1, and the second electrode of the second transistor M2 is electrically connected with the first electrode of the fifth transistor M5. The gate of the third transistor M3 is electrically connected with the first scanning line for transmitting the first scanning line signal SCAN1; the first electrode of the third transistor M3 is electrically connected with the second electrode of the second transistor M2, and the second electrode of the third transistor M3 is electrically connected with the gate of the second transistor M2. The gate of the fourth transistor M4 is electrically connected with the light emitting line for transmitting the light emitting line signal EMIT; the first electrode of the fourth transistor M4 is electrically connected with the first power line for transmitting the first power voltage PVDD; and the second electrode of the fourth transistor M4 is electrically connected with the first electrode of the second transistor. The gate of the fifth transistor M5 is electrically connected with the light emitting line for transmitting the light emitting line signal EMIT, the first electrode of the fifth transistor M5 is electrically connected with the second electrode of the second transistor M2, and the second electrode of the fifth transistor M5 is electrically connected with the second electrode of the sixth transistor M6. The first electrode of the first capacitor C1 is electrically connected with the first power line for transmitting the first power voltage PVDD, and the second electrode of the first capacitor C1 is electrically connected with the gate of the second transistor M2. The gate of the sixth transistor M6 is electrically connected with the second scanning line for transmitting the second scanning line signal SCAN2; the first electrode (the input end) of the sixth transistor M6 is electrically connected with the reference signal line for transmitting the reference signal REF; and the second electrode (the output end) of the sixth transistor M6 is electrically connected with the light emitting element D, and the sixth transistor M6 is configured to transmit the reference signal REF with the first potential to the light emitting element D in response to the second scanning line signal SCAN2. The gate of the seventh transistor M7 is electrically connected with the second scanning line for transmitting the second scanning line signal SCAN2; the input end of the seventh transistor M7 is electrically connected with the second electrode (output end) of the sixth transistor M6 at the node A; and the second electrode of the seventh transistor M7 is electrically connected with the gate of the second transistor M2 at the node B.

It should be noted that, in the embodiment shown in FIG. 8, the electrical connection relationships of the first transistor M1 to the fifth transistor are also suitable for the pixel driving circuits in embodiments corresponding to FIGS. 1-7, and the specific contents are not repeated again.

It should be noted that, in the embodiment shown in FIG. 8, the electrical connection manners of the sixth transistor M6 and the seventh transistor may refer to any of solutions in embodiments shown in FIGS. 1-7 and are not limited to the solution shown in FIG. 8, as long as the second potential is greater than the first potential.

Figure 9:
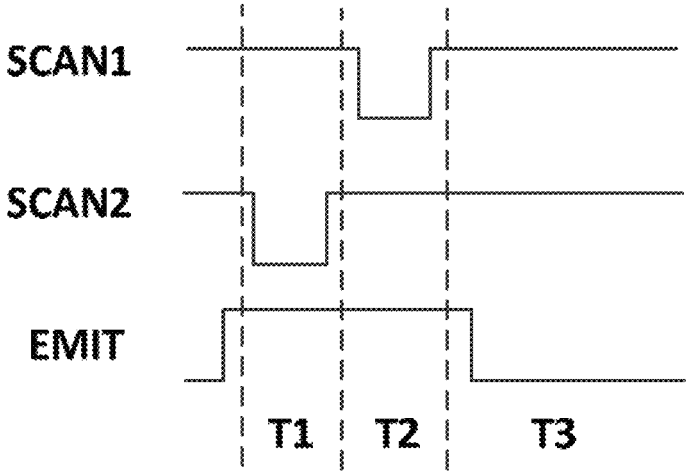
FIG. 9 is a time sequence in one driving method of a pixel driving circuit provided by an embodiment of the present disclosure.

FIG. 9 shows the time sequence in a driving method of a pixel driving circuit provided by an embodiment of the present disclosure. Next, the working principle and the technical effects of the pixel driving circuit proposed by the embodiment of the present disclosure are described by taking the pixel driving circuit shown in FIG. 8 as an example and in combination with FIG. 9.

The driving method shown in FIG. 9 includes the following three phases: an initialization phase T1, a data writing phase T2 and a light emitting phase T3.

Firstly, at the initialization phase T1, both the sixth transistor M6 and the seventh transistor M7 are turned on in response to the second scanning line signal SCAN2, thus a reference signal REF with any initial potential is transmitted to the node A through the sixth transistor M6 to initialize the potential of the anode of the light emitting element D. At this moment, the reference signal REF has the first potential v1. Since the seventh transistor M7 is turned on, the reference signal REF with the first potential v1 is then transmitted to the second node B through the seventh transistor M7 to initialize the potential of the gate of the second transistor M2, and at this moment, the potential of the reference signal REF is changed from the first potential v1 to the second potential v2 (the reason of the change of the potential is explained in detail in above embodiments, which is not repeated again and can refer to the above contents). At the phase, the data signals stored in the first capacitor C1 and the anode of the light emitting element D are initialized.

At the data writing phase T2, both the first transistor M1 and the third transistor M3 are turned on in response to the first scanning line signal SCAN1; and since the third transistor M3 is turned on, the second transistor M2 is connected in a diode connection manner. At the phase, a transmission path of the data signal is formed, and the data line signal DATA passes through the first transistor M1 and the third transistor M3 in sequence and is finally transmitted to the gate of the second transistor M2. Since the second transistor M2 is in a diode connection manner, the second transistor M2 is cut off when a potential of the gate of the second transistor M2 reaches $V_{DATA}+V_{th}$. At this time, the writing phase of the data signal is ended, and $V_{DATA}+V_{th}$ is stored in the first capacitor C1, where $V_{DATA}$ refers to the potential of the data line signal, and $V_{th}$ refers to threshold voltage of the second transistor M2.

At the light emitting phase T3, the fourth transistor M4 and the fifth transistor M5 are turned on in response to the light emitting line signal EMIT. Therefore, a current path is formed among the fourth transistor M4, the second transistor M2 and the fifth transistor M5. As a result, the first power voltage PVDD is transmitted to the input end of the second transistor M2, the second transistor generates a driving current, and the driving current flows to the light emitting element D through the fifth transistor M5, so that the light emitting element D emits light. Specifically, the driving current at the light emitting phase can refer to the following formula:

$$I_{oled}=K(V_{GS}-V_{th})^2=K(V_{DATA}-V_{DD})^2$$

where $I_{oled}$ represents the current flowing into the light emitting element D, K represents an intrinsic parameter related to the structure of the second transistor, and $V_{DD}$ represents the potential of the first power voltage PVDD.

From the above formula, it can be seen that the current flowing into the light emitting element D is related to the data line signal and the first power voltage and is unrelated to the threshold voltage of the second transistor M2. Therefore, threshold detection and compensation for the pixel circuit can be realized. In addition, in the driving method, since the initialization for different potentials at the nodes are carried out on the anode (the node A) of the LED (Light Emitting Diode) and the gate (the node B) of the second transistor M2 respectively at the initialization phase, the technical problems proposed in above embodiments are solved. Further, in the present embodiment, since one REF line is adopted to provide initialization voltage with different potentials to the node A and the node B, the layout area can be further saved.

It should be noted that, the driving method of the pixel driving circuit shown in FIG. 9 corresponds to the pixel driving circuit 106 shown in FIG. 8. However, the structure of the pixel driving circuit is not limited to the embodiment shown in FIG. 8. For example, the pixel driving circuit may also be a circuit the transistor in which are all N-type transistors. Then in this case, a driving waveform in the driving method is opposite in phase to that in FIG. 9, and the specific content is not repeated again. A driving waveform in the driving method should be adjusted adaptively if the pixel driving circuit includes not only N-type transistors but also P-type transistors, and the specific content is not repeated again.

It may be understood that, the driving method given by FIG. 9 is also suitable for the pixel driving circuits of embodiments of the present disclosure in FIGS. 1-5, the difference lies in the input manner of the reference signal and the input manner of the additional reference signal, and the specific contents can refer to above embodiments and are not repeated again. The threshold compensation and the initialization can be achieved and the layout area can be more effectively saved as long as the followings are ensured: the initialization is carried out on the potentials at the anode (the node A) of the LED and the gate (the node B) of the second transistor M2 respectively at the initialization phase, the initialized potentials are different, and the first potential v1 is less than the second potential v2.

Figure 10:
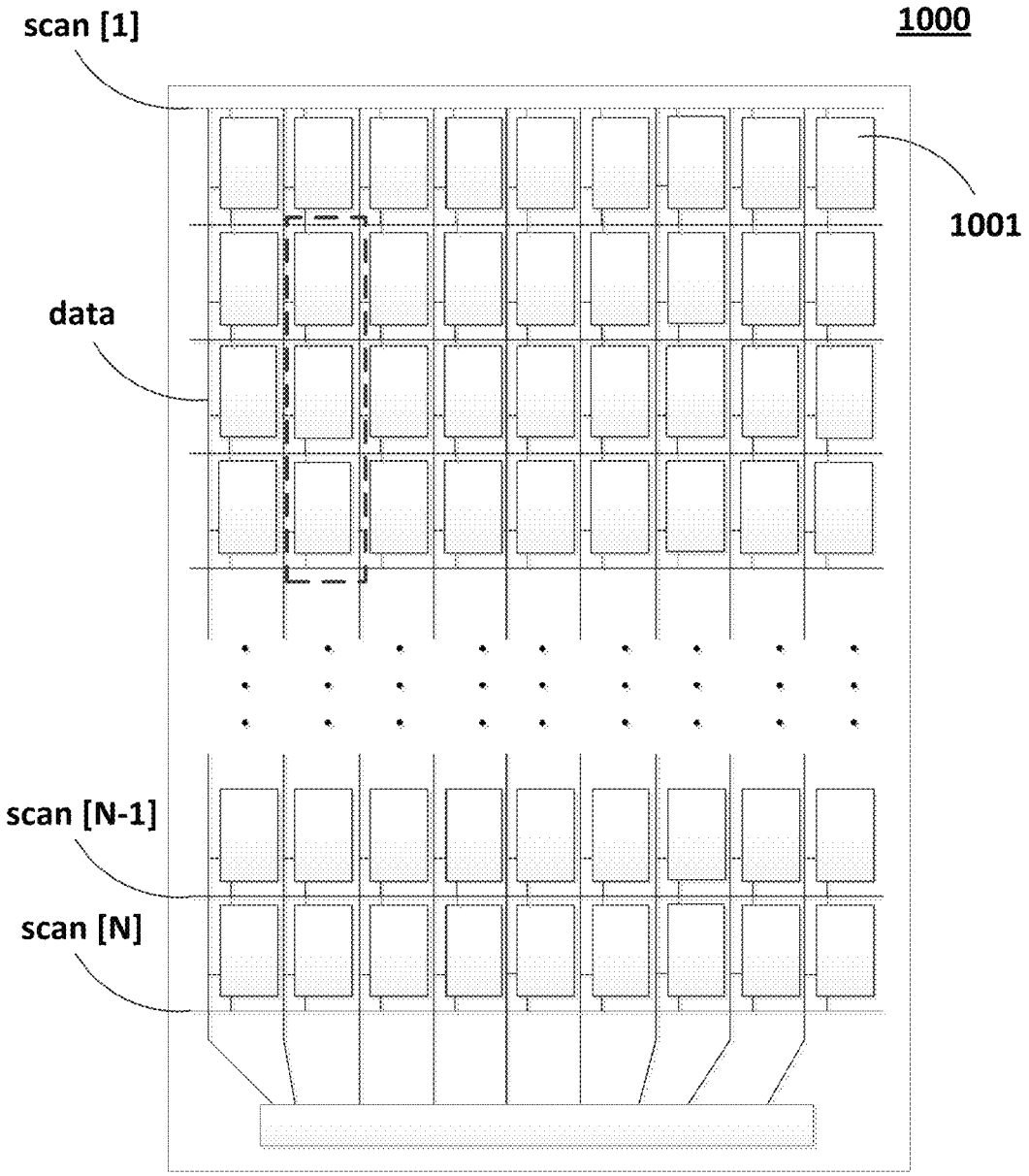
FIG. 10 is a schematic diagram illustrating a top view of a pixel array provided by an embodiment of the present disclosure.

FIG. 10 is a pixel array 1000 provided by an embodiment of the present disclosure. The pixel array 1000 includes a plurality of pixel driving circuits 1001. The plurality of pixel driving circuits 1001 are arranged in a matrix form with N rows and M columns, and both N and M are positive integers which are greater than or equal to 2. The pixel array 1000 further includes a plurality of signal lines: scanning signal lines (scan [1]~scan[N]), a data signal line (data), light emitting signal lines (not shown in the figure) and a power signal line (not shown in the figure). Each of the pixel driving circuits is simultaneously connected with two scanning signal lines scan [N−1] and scan[N], one data signal line (data), one light emitting signal line (not shown in the figure) and one power signal line (not shown in the figure). The specific structure of the pixel array belongs to the existing art, is not particularly limited and may be different from the schematic diagram shown in FIG. 10, and the specific structure prevails. In order to describe the specific structure of the pixel driving circuits 1001 in the pixel array 1000, any three adjacent pixel driving circuits 1001 (outlined by dotted lines in FIG. 10) in the column direction in the array are taken as examples for description, and the specific contents can refer to any three adjacent pixel driving circuits 200 in the column direction provided by the embodiment of the present disclosure in FIG. 11. Since the structures of the three adjacent pixel driving circuits are identical or similar, the pixel driving circuit in the Nth row is taken as an example and is mainly introduced.

Figure 11:
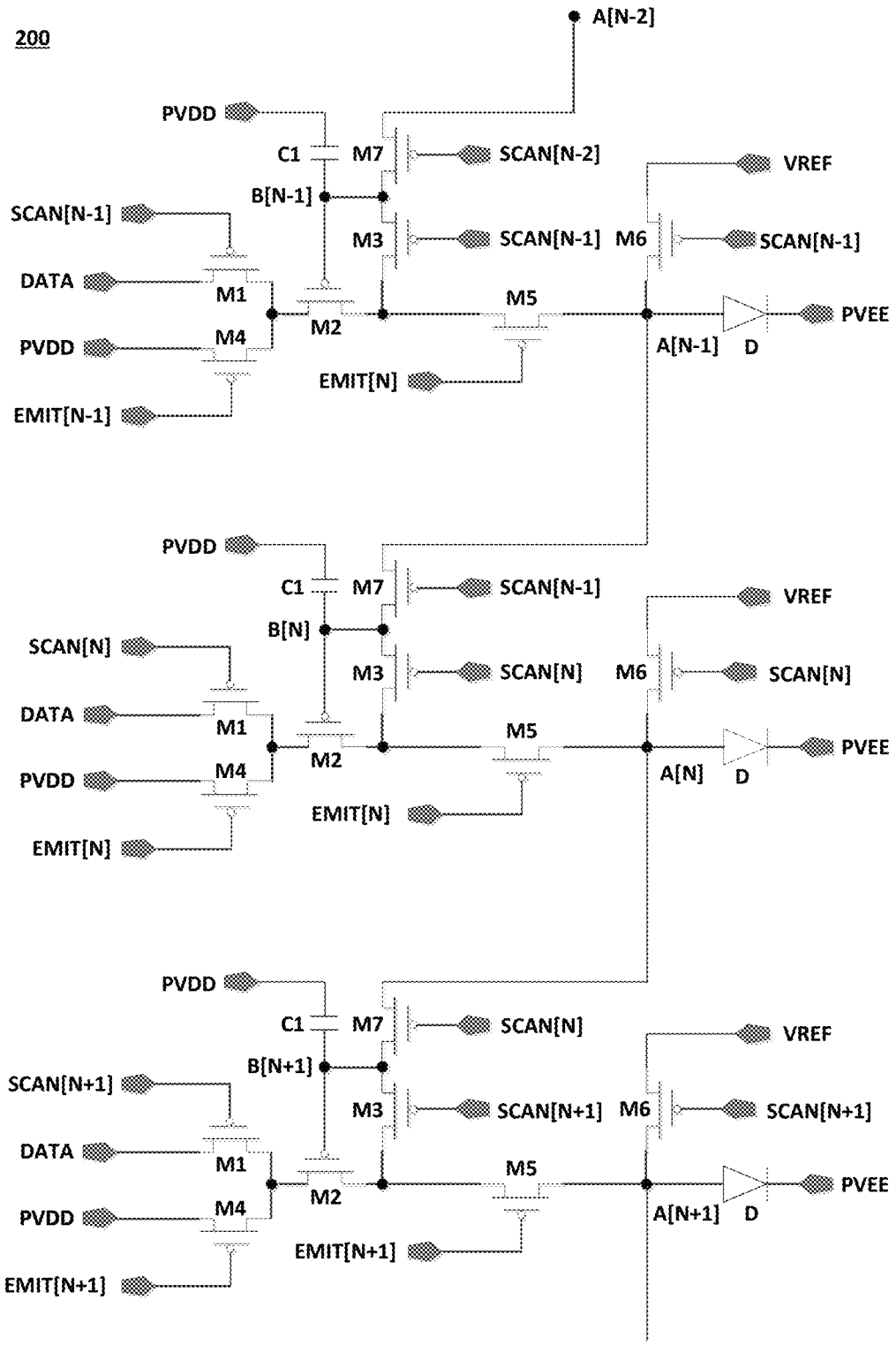
FIG. 11 is an enlarged view illustrating the dashed box in the pixel array shown in FIG. 10.

The structure of the pixel driving circuit in the Nth row can refer to the structure of the pixel driving circuit in the embodiment corresponding to FIG. 8, and includes: the first transistor M1 to the seventh transistor M7; the gate of the first transistor M1 is electrically connected with the Nth-row scanning line for transmitting the Nth-row scanning line signal SCAN[N]; the first electrode of the first transistor M1 is electrically connected with the data signal line for transmitting the data signal voltage DATA; and the second electrode of the first transistor M1 is electrically connected with the first electrode of the second transistor M2. The gate of the second transistor M2 is electrically connected with the second electrode of the seventh transistor M7, the first electrode of the second transistor M2 is electrically connected with the second electrode of the first transistor M1, and the second electrode of the second transistor M2 is electrically connected with the first electrode of the fifth transistor M5. The gate of the third transistor M3 is electrically connected with the Nth-row scanning line for transmitting the Nth-row scanning line signal SCAN[N]; and the first electrode of the third transistor M3 is electrically connected with the second electrode of the second transistor M2, and the second electrode of the third transistor M3 is electrically connected with the gate of the second transistor M2. The gate of the fourth transistor M4 is electrically connected with a Nth-row light emitting line for transmitting a Nth-row light emitting line signal EMIT[N]; the first electrode of the fourth transistor M4 is electrically connected with a first power line for transmitting the first power voltage PVDD; and the second electrode of the fourth transistor M4 is electrically connected with the first electrode of the second transistor M2. The gate of the fifth transistor M5 is electrically connected with the Nth-row light emitting line for transmitting the Nth-row light emitting line signal EMIT[N]; and the first electrode of the fifth transistor M5 is electrically connected with the second electrode of the second transistor M2, and the second electrode of the fifth transistor M5 is electrically connected with the second electrode of the sixth transistor M6. The first electrode of the first capacitor C1 is electrically connected with the first power line for transmitting the first power voltage PVDD, and the second electrode of the first capacitor C1 is electrically connected with the gate of the second transistor M2. The gate of the sixth transistor M6 is electrically connected with the Nth-row scanning line for transmitting the Nth-row scanning line signal SCAN[N]; the first electrode (the input end) of the sixth transistor M6 is electrically connected with a reference signal line for transmitting the reference signal REF; and the second electrode (the output end) of the sixth transistor M6 is electrically connected with the light emitting element D. The gate of the seventh transistor M7 is electrically connected with the (N−1)th-row scanning line for transmitting the (N−1)th-row scanning line signal SCAN[N−1]; the first electrode of the seventh transistor M7 is electrically connected with the second electrode (the output end) of the sixth transistor M6 in the pixel driving circuit in the (N−1)th row at a node A[N−1]; and the second electrode of the seventh transistor M7 is electrically connected with the gate of the second transistor M2 at a node B[N]. In FIG. 11, A[N−1] represents the electrical connection node of the light emitting element and the second electrode of the sixth transistor M6 in the pixel driving circuit in the (N−1)th row, and B[N−1] represents an electrical connection node of the gate of the second transistor M2 and the second electrode of the seventh transistor M7 in the pixel driving circuit in the (N−1)th row; and A[N] represents an electrical connection node of the light emitting element and the second electrode of the sixth transistor M6 in the pixel driving circuit in the Nth row, and B[N] represents the electrical connection node of the gate of the second transistor M2 and the second electrode of the seventh transistor M7 in the pixel driving circuit in the Nth row. A[N+1] represents an electrical connection node of the light emitting element and the second electrode of the sixth transistor M6 in the pixel driving circuit in the (N+1)th row, B[N+1] represents an electrical connection node of the gate of the second transistor M2 and the second electrode of the seventh transistor M7 in the pixel driving circuit in the (N+1)th row. By Such Analogy, A[N−2] represents an electrical connection node of the light emitting element and the second electrode of the sixth transistor M6 in the pixel driving circuit in the (N−2)th row.

For the pixel driving circuit shown in FIG. 11, a reference signal REF with any initial potential is changed to the first potential v1 when the reference signal REF is transmitted to the node A[N−1] through the sixth transistor M6 in the pixel driving circuit in the (N−1)th row. Since both the gate of the sixth transistor M6 in the pixel driving circuit in the (N−1)th row and the gate of the seventh transistor M7 in the pixel driving circuit in the Nth row are connected with the (N−1)th-row scanning signal line SCAN[N−1], the sixth transistor M6 in the pixel driving circuit in the (N−1)th row and the seventh transistor M7 in the pixel driving circuit in the Nth row are simultaneously turned on. In this case, the reference signal VREF with the first potential v1 transmitted to the node A[N−1] is further be transmitted to the node B[N] through the seventh transistor M7 in the pixel driving circuit in the Nth row. At this moment, the potential of the reference signal VREF is changed to v2, and the second potential v2 is greater than the first potential v1. (The reason why the second potential v2 is greater than the first potential v1 can refer to above embodiments, which is not repeated again.) Similarly, the second potential v2 transmitted to the node B[N+1] is greater than the first potential v1 at the node A[N] (N is a positive integer which is greater than or equal to 2), and so on. According to the design solution of the pixel driving circuit shown in FIG. 11, the anode of the light emitting element in the pixel driving circuit in the previous row (the (N−1)th row) is electrically connected with the input end of the seventh transistor M7 in the pixel driving circuit in the row (the Nth row), and the initialization for different potentials at the nodes are carried out on the anode (the node A) of the LED and the gate (the node B) of the second transistor M2 respectively on the basis that the purposes of threshold detection and compensation for the pixel circuit are achieved, thereby solving the technical problems proposed in above embodiments, saving the layout area more effectively and facilitating arrangement of pixels.

It should be noted that, the structure of a certain pixel driving circuit in any three adjacent pixel driving circuits in the column direction in FIG. 10 and FIG. 11 is not limited to that shown in FIG. 11, namely, the nodes or the signal lines in the pixel driving circuit in any row that are electrically connected with the input end, the output end and the gate of the sixth transistor M6 may be connected directly or indirectly, the nodes or the signal lines in the pixel driving circuit at any row that are electrically connected with the input end, the output end and the gate of the seventh transistor M7 may be connected directly or indirectly, the connection form is not limited as long as the followings are ensured: the second potential v2 transmitted to the node B[N+1] is greater than the first potential v1 at the node A[N] (N is a positive integer which is greater than or equal to 2).

It should be noted that, the structure of a certain pixel driving circuit in any three adjacent pixel driving circuits in the column direction in FIG. 10 and FIG. 11 is not limited to that shown in FIG. 11, namely, the specific connection relationship of the first transistor M1 to the fifth transistor M5 in the pixel driving circuit in any row is not limited to the situation shown in FIG. 11 and can refer to the situations of embodiments shown in FIGS. 1-7. Additionally, width-to-length ratios of channels or the total number of discrete gates of the sixth transistor M6 and the seventh transistor M7 are not limited and can refer to various implementation manners of above embodiments, as long as the followings are ensured: the second potential v2 transmitted to the node B[N+1] is greater than the first potential v1 at the node A[N] (N is a positive integer which is greater than or equal to 2).

Figure 12:
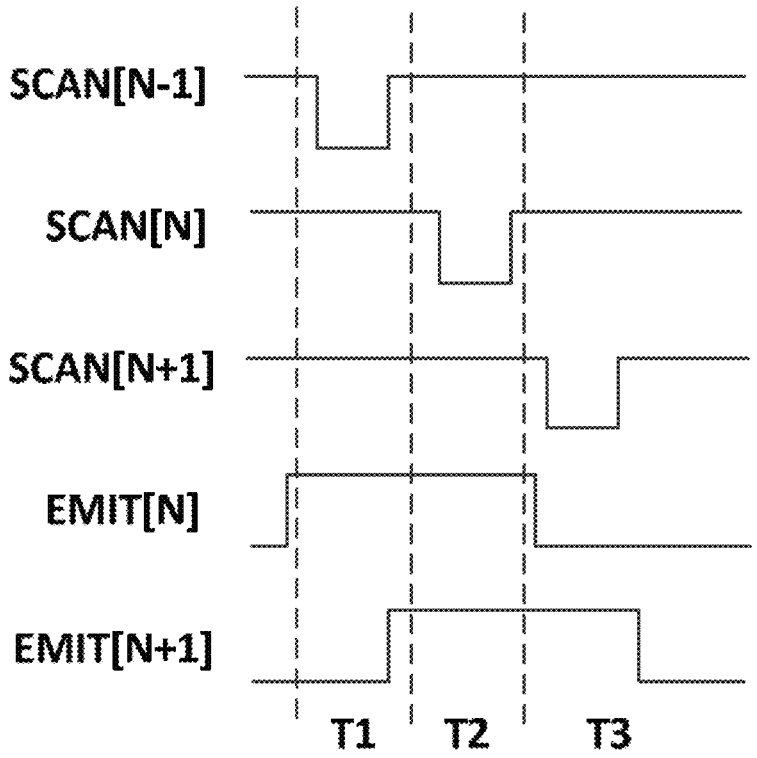
FIG. 12 is a time sequence in one driving method of a pixel array provided by an embodiment of the present disclosure.

FIG. 12 shows the time sequence of a driving method for a pixel array proposed by an embodiment of the present disclosure. Next, the working principle and the technical effect of the pixel driving circuit in the embodiment of the present disclosure is described in combination with the pixel driving circuit 200 shown in FIG. 11.

The driving method shown in FIG. 12 includes the follows three phases: an initialization phase T1, a data writing phase T2 and a light emitting phase T3.

Firstly, at the initialization phase T1, both the sixth transistor M6 in the pixel driving circuit in the (N−1)th row and the seventh transistor M7 in the pixel driving circuit in the Nth row are turned on in response to the (N−1)th-row scanning line signal SCAN[N−1]. A reference signal REF with any initial potential is transmitted to the node A[N-1] through the sixth transistor M6 in the pixel driving circuit in the (N−1)th row, so as to initialize the potential at the anode of the light emitting element D in the (N−1)th row. At the moment, the potential of the reference signal REF is the first potential v1. Since the seventh transistor M7 in the pixel driving circuit in the Nth row is also turned on, the reference signal REF with the first potential v1 is then transmitted to the second node B[N] through the seventh transistor M7 in the pixel driving circuit in the Nth row, so as to initialize the potential at the gate of the second transistor M2 in the pixel driving circuit in the Nth row. At this moment, the potential of the reference signal REF is changed from the first potential v1 to the second potential v2 (the reason of the change of the potential is explained in detail in above embodiments, which is not repeated again and can refer to the above contents). At the phase, the data signal stored in the first capacitor C1 in the pixel driving circuit in the Nth row and the potential of the anode of the light emitting element D in the pixel driving circuit in the (N−1)th row are initialized.

At the data writing phase T2, both the first transistor M1 and the third transistor M3 in the pixel driving circuit in the Nth row are turned on in response to the Nth-row scanning line signal SCAN[N]. Since the third transistor M3 is turned on, the second transistor M2 in the pixel driving circuit in the Nth row is connected in a diode connection manner. At the phase, a transmission path of the data signal is formed, and thus a data line signal DATA passes through the first transistor M1 and the third transistor M3 in the pixel driving circuit in the Nth row in sequence and is finally transmitted to the gate of the second transistor M2. Since the second transistor M2 is in a diode connection manner, the second transistor M2 is cut off when the potential of the gate of the second transistor M2 reaches VDATA+Vth. At this time, the writing phase of the data signal is ended, and VDATA+Vth is stored in the first capacitor C1 in the pixel driving circuit in the Nth row, where VDATA refers to the potential of the data line signal, and Vth refers to the threshold voltage of the second transistor M2. Meanwhile, at this phase, the sixth transistor M6 in the pixel driving circuit in the Nth row is turned on in response to the Nth scanning line signal SCAN[N], a reference signal REF with any initial potential is transmitted to the node A[N] through the sixth transistor M6 in the pixel driving circuit in the Nth row, so as to initialize potential at the anode of the light emitting element D in the Nth row. At this moment, the potential of the reference signal REF is the first potential v1.

At the light emitting phase T3, the fourth transistor M4 and the fifth transistor M5 in the pixel driving circuit at the Nth row are turned on in response to the Nth-row light emitting line signal EMIT[N]. Therefore, a current path is formed among the fourth transistor M4, the second transistor M2 and the fifth transistor M5, the first power voltage PVDD is transmitted to the input end of the second transistor M2, the second transistor in the pixel driving circuit in the Nth row generates a driving current, and the driving current flows to the light emitting element D in the pixel driving circuit in the Nth row through the fifth transistor M5, so that the light emitting element D emits light. Specifically, the driving current at the light emitting phase can refer to the following formula:

$$I_{oled}=K(V_{GS}-V_{th})^2=K(V_{DATA}-V_{DD})^2$$

where $I_{oled}$ represents the current flowing into the light emitting element D, K represents an intrinsic parameter related to the structure of the second transistor, and VDD represents the potential of the first power voltage PVDD.

From the above formula, it can be seen that the current flowing into the light emitting element D in the pixel driving circuit in the Nth row is related to the data line signal and the first power voltage, and is unrelated to the threshold voltage of the second transistor M2 in the pixel driving circuit in the Nth row. Therefore, threshold detection and compensation for the pixel circuit can be realized. In addition, in the driving method, since the initialization for the potentials at the nodes are carried out on the anode (the node A[N−1]) of the LED in the pixel driving circuit in the (N−1)th row and the gate (the node B[N]) of the second transistor M2 in the pixel driving circuit in the Nth row respectively at the initialization phase, the technical problems proposed in above embodiments are solved. Further, in the present embodiment, since the anode of the light emitting element in the pixel driving circuit in the previous row (the (N−1)th row) is electrically connected with the input end of the seventh transistor in the pixel driving circuit in the present row (the Nth row), one reference signal line can be adopted to provide initialization voltage with different potentials to the node A[N] and the node B[N], and layout area can be saved more effectively.

It should be noted that, the driving method of the pixel driving circuit shown in FIG. 12 corresponds to the pixel driving circuit 200 shown in FIG. 11, however, the structure of the pixel driving circuit is not limited to the embodiment shown in FIG. 11. For example, the pixel driving circuit may also be a circuit in which all transistors are N-type transistors. Then in this case, a driving waveform in the driving method is opposite in phase to that in FIG. 12, and the specific content is not repeated again. A driving waveform in the driving method may be adjusted adaptively according to the types of the transistors if the pixel driving circuit includes not only N-type transistors but also P-type transistors, as long as the above technical purposes can be realized, and the specific content is not repeated again.

It may be understood that, the driving method given by FIG. 12 is also suitable for the pixel driving circuits of above embodiments of the present disclosure, namely, the width-to-length ratios of the channels and the total number of the discrete gates of each transistor of the first transistor M1 to the seventh transistor M7 are not limited and can be randomly adjusted, as long as the followings are ensured: the potential initialization at the nodes are carried out on the anode (the node A[N−1]) of the LED and the gate (the node B[N]) of the second transistor M2 respectively at the initialization phase, the initialized potentials are different, and the first potential v1 is less than the second potential v2, so as to ensure the completion of the threshold compensation, realize the initialization and save the layout area more effectively.

It may be understood that, for the embodiment shown in FIG. 12, the width-to-length ratios of the channels and the total number of the discrete gates of each transistor of the first transistor M1 to the seventh transistor M7 may also be additionally set, in particular to the setting for the sixth transistor M6 and the seventh transistor M7. Specifically, the width-to-length ratio of the channel of the sixth transistor M6 in the pixel driving circuit in the (N−1)th row is set to be greater than that of the seventh transistor in the pixel driving circuit at the Nth row, or the total number of the gates (the discrete gates) of the sixth transistor M6 in the pixel driving circuit in the (N−1)th row is set as P, the total number of the gates (the discrete gates) of the seventh transistor M7 in the pixel driving circuit in the Nth row is set as Q, both P and Q are positive integers which are greater than or equal to 1, and Q is greater than P. The specific design manner may refer to the above contents, which is not repeated again. It only needs to ensure that: the potential initialization at the nodes are carried out on the anode (the node A[N−1]) of the LED and the gate (the node B[N]) of the second transistor M2 respectively at the initialization phase, the initialized potentials are different, and the first potential v1 is less than the second potential v2, so as to ensure the completion of the threshold compensation, realize the initialization and save the layout area more effectively.

It should be noted that, for any of above embodiments, an example that all the transistors of the pixel driving circuit are the P-type transistors is taken for description, but the types of the transistors are not limited. Specifically, all of the first transistor M1 to the seventh transistor M7 may be P-type transistors or all of the first transistor M1 to the seventh transistor M7 may be P-type transistors may be N-type transistors, or a part of transistors are P-type transistors, and the other part of transistors are N-type transistors. Under the situation that all of the first transistor M1 to the seventh transistor M7 are P-type transistors, signal input ends of the first transistor M1 to the seventh transistor M7 are generally sources, and signal output ends of the first transistor M1 to the seventh transistor M7 are generally drains. In this case, the signal V1, the signal V2, the additional reference signal V3 and the reference signal VREF are all low-potential signals. Under the situation that the first transistor M1 to the seventh transistor M7 are all N-type transistors, the signal input ends of the first transistor M1 to the seventh transistor M7 are generally drains, and the signal output ends of the first transistor M1 to the seventh transistor M7 are generally sources. In this case, the signal V1, the signal V2, the additional reference signal V3 and the reference signal VREF are high-potential signals.

Figure 13:
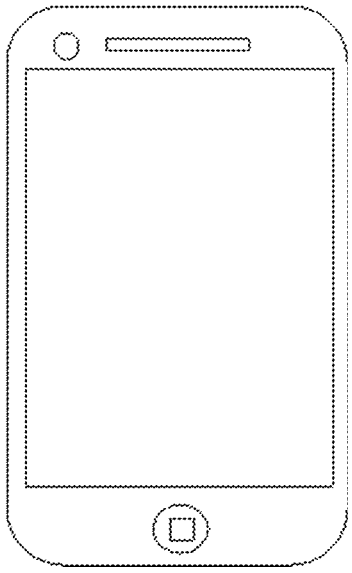
FIG. 13 is an organic light emitting display panel proposed by an embodiment of the present disclosure.

FIG. 13 is an organic light emitting display panel proposed by an embodiment of the present disclosure. The organic light emitting display panel may be a mobile phone shown in FIG. 13 or a touch apparatus such as a computer and the like; and specifically, the organic light emitting display panel includes the pixel array proposed in any of above embodiments.

It should be noted that, concrete details are illustrated in the following description in order to fully understand the present disclosure. However, the present disclosure can be implemented in various other manners different from the manners described herein, and those skilled in the art can make similar popularization under the situation of not departing from the connotation of the present disclosure. Therefore, the present disclosure is not limited by specific implementation manners disclosed below.

It should be noted that, words of locations such as "on", "under", "left", "right" and the like described in embodiments of the present disclosure are described by angles shown in the drawings and should not be understood as limitations to embodiments of the present disclosure. Additionally, in the context, it should also be understood that, one element can not only be directly formed "on" or "under" the other element, but also be indirectly formed "on" or "under" the other element by an intermediate element when it is mentioned that the element is formed "on" or "under" the other element.

It should be noted that, the organic light emitting display panel further includes some necessary structures such as an IC, signal lines and the like besides components shown and described in FIG. 5A and FIG. 5B, which are the common general knowledge of the field and are also not repeated again.

The above contents are the further detailed descriptions for the present disclosure in combination with the specific preferable implementation manners, and it is not believed that the specific implementation of the present disclosure is only limited to the descriptions. Those ordinary skilled in the technical field of the present disclosure can also make several simple deductions or replacements on the premise of not departing from the concept of the present disclosure, which should belong to the protection scope of the present disclosure.

What is claimed is:

1. A pixel driving circuit, comprising:

a first transistor, configured to transmit a data signal voltage in response to a first scanning line signal;

a second transistor, configured to generate a driving current according to the data signal voltage transmitted by the first transistor;

a third transistor, configured to detect a deviation of a threshold voltage of the second transistor and perform a self-compensation on the deviation;

a fourth transistor, configured to transmit a first power voltage to the second transistor in response to a light emitting line signal;

a fifth transistor, configured to transmit the driving current generated by the second transistor to a light emitting element in response to the light emitting line signal, wherein the light emitting element is configured to emit a light corresponding to the driving current;

a sixth transistor, configured to transmit a signal with a first potential to the light emitting element in response to a second scanning line signal;

a seventh transistor, configured to transmit a signal with a second potential to a gate of the second transistor in response to the second scanning line signal, wherein the second potential is greater than the first potential; and a first capacitor, configured to store the data signal voltage transmitted to the second transistor.

2. The pixel driving circuit according to claim 1, wherein the first potential is in a range of −4.5V~−3.5V, having end values; and the second potential is in a range of −2.0V~1.0V, having end values.

3. The pixel driving circuit according to claim 1, wherein a gate of the sixth transistor is electrically connected with a second scanning line for transmitting the second scanning line signal; a first electrode of the sixth transistor is electrically connected with a reference signal line for transmitting a reference signal; and a second electrode of the sixth transistor is electrically connected with the light emitting element, and the signal with the first potential is the reference signal passed through the sixth transistor.

4. The pixel driving circuit according to claim 3, wherein the second electrode of the sixth transistor is directly connected with a first electrode of the light emitting element.

5. The pixel driving circuit according to claim 3, wherein a gate of the seventh transistor is electrically connected with the second scanning line; a first electrode of the seventh transistor is electrically connected with the second electrode of the sixth transistor; and a second electrode of the seventh transistor is electrically connected with the gate of the second transistor, and the signal with the second potential is the reference signal passed through the seventh transistor.

6. The pixel driving circuit according to claim 5, wherein the first electrode of the seventh transistor is directly connected with the second electrode of the sixth transistor.

7. The pixel driving circuit according to claim 3, wherein a gate of the seventh transistor is electrically connected with the second scanning line; a first electrode of the seventh transistor is electrically connected with an additional reference signal line for providing an additional reference signal; and a second electrode of the seventh transistor is electrically connected with the gate of the second transistor, and the signal with the second potential is the additional reference signal passed the seventh transistor.

8. The pixel driving circuit according to claim 7, wherein a potential of the additional reference signal is the same as a potential of the reference signal.

9. The pixel driving circuit according to claim 8, wherein a width-to-length ratio (W/L) of a channel of the sixth transistor is greater than W/L of the seventh transistor.

10. The pixel driving circuit according to claim 9, wherein the width-to-length ratio of the channel of the sixth transistor is at least six times of W/L of the seventh transistor.

11. The pixel driving circuit according to claim 8, wherein a total number of the gates of the sixth transistor is P, a total number of the gates of the seventh transistor is Q, and both P and Q are positive integers which are greater than or equal to 1, and Q is greater than P.

12. The pixel driving circuit according to claim 11, wherein P is equal to 1, and Q is equal to 3.

13. The pixel driving circuit according to claim 1, further comprising a second capacitor, wherein a first electrode of the second capacitor is electrically connected with a gate of the first transistor, and a second electrode of the second capacitor is electrically connected with the gate of the second transistor.

14. The pixel driving circuit according to claim 1, wherein the first transistor to the seventh transistor are all P-type transistors.

15. The pixel driving circuit according to claim 14, wherein the reference signal is a signal with a low potential.

16. The pixel driving circuit according to claim 1, wherein the first transistor to the seventh transistor are all N-type transistors.

17. The pixel driving circuit according to claim 16, wherein the reference signal is a signal with a high potential.

18. The pixel driving circuit according to claim 1, wherein a gate of the first transistor is electrically connected with a first scanning line for transmitting the first scanning line signal; a first electrode of the first transistor is electrically connected with a data signal line for transmitting the data signal voltage; and a second electrode of the first transistor is electrically connected with a first electrode of the second transistor.

19. The pixel driving circuit according to claim 1, wherein the gate of the second transistor is electrically connected with a second electrode of the seventh transistor; a first electrode of the second transistor is electrically connected with a second electrode of the first transistor; and a second electrode of the second transistor is electrically connected with a first electrode of the fifth transistor.

20. The pixel driving circuit according to claim 1, wherein a gate of the third transistor is electrically connected with a first scanning line for transmitting the first scanning line signal; a first electrode of the third transistor is electrically connected with a second electrode of the second transistor; and a second electrode of the third transistor is electrically connected with the gate of the second transistor.

21. The pixel driving circuit according to claim 1, wherein a gate of the fourth transistor is electrically connected with a light emitting line for transmitting the light emitting line signal; a first electrode of the fourth transistor is electrically connected with a first power line for transmitting the first power voltage; and a second electrode of the fourth transistor is electrically connected with a first electrode of the second transistor.

22. The pixel driving circuit according to claim 1, wherein a gate of the fifth transistor is electrically connected with a light emitting line for transmitting the light emitting line signal; a first electrode of the fifth transistor is electrically connected with a second electrode of the second transistor; and a second electrode of the fifth transistor is electrically connected with a second electrode of the sixth transistor.

23. The pixel driving circuit according to claim 1, wherein a first electrode of the first capacitor is electrically connected with a first power line for transmitting the first power voltage; and a second electrode of the first capacitor is electrically connected with the gate of the second transistor.

24. A driving method of the pixel driving circuit according to claim 1, wherein the driving method comprises:

at an initialization phase, both the sixth transistor and the seventh transistor are turned on in response to the second scanning line signal, the signal with the first potential is transmitted to the light emitting element through the sixth transistor, and the signal with the second potential is transmitted to the gate of the second transistor through the seventh transistor;

at a data writing phase, both the first transistor and the third transistor are turned on in response to the first scanning line signal, and the data signal voltage is transmitted to the gate of the second transistor through the first transistor and the third transistor; and at a light emitting phase, both the fourth transistor and the fifth transistor are turned on in response to the light emitting line signal, and the driving current generated in response to the data signal voltage exerted on the second transistor is provided to the light emitting element through the fifth transistor, so that the light emitting element emits a light.

25. The driving method of the pixel driving circuit according to claim 24, wherein a gate of the sixth transistor is electrically connected with a second scanning line for transmitting the second scanning line signal; a first electrode of the sixth transistor is electrically connected with a reference signal line for transmitting a reference signal; a second electrode of the sixth transistor is electrically connected with the light emitting element; and the reference signal is transmitted from the first electrode of the sixth transistor to the second electrode of the sixth transistor.

26. The driving method of the pixel driving circuit according to claim 25, wherein a gate of the seventh transistor is electrically connected with the second scanning line; a first electrode of the seventh transistor is electrically connected with the second electrode of the sixth transistor; a second electrode of the seventh transistor is electrically connected with the gate of the second transistor; and the reference signal is transmitted from the first electrode of the sixth transistor to the second electrode of the sixth transistor, and then is transmitted to the second electrode of the seventh transistor from the first electrode of the seventh transistor.

27. The driving method of the pixel driving circuit according to claim 25, wherein a gate of the seventh transistor is electrically connected with the second scanning line; a first electrode of the seventh transistor is electrically connected with an additional reference signal line for providing an additional reference signal; a second electrode of the seventh transistor is electrically connected with the gate of the second transistor, wherein the additional reference signal is transmitted from the first electrode of the seventh transistor to the second electrode of the seventh transistor.

* * * * *